US007434801B2

(12) United States Patent
Yang

(10) Patent No.: US 7,434,801 B2
(45) Date of Patent: Oct. 14, 2008

(54) VERSATILE PAPER FEEDING DEVICE OF IMAGE FORMING APPARATUS

(75) Inventor: Chun-seung Yang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 107 days.

(21) Appl. No.: 11/500,347

(22) Filed: Aug. 8, 2006

(65) Prior Publication Data

US 2007/0090587 A1 Apr. 26, 2007

(30) Foreign Application Priority Data

Oct. 20, 2005 (KR) ..... 10-2005-0099176

(51) Int. Cl.
*B65H 1/00* (2006.01)

(52) U.S. Cl. ..... 271/171; 271/240; 271/241; 271/248; 271/145; 399/393; 347/104; 400/630; 400/633; 400/633.1; 400/633.2

(58) Field of Classification Search ..... 271/113, 271/240, 241, 248, 145, 171; 347/104; 399/393; 400/630, 633, 633.1, 633.2
See application file for complete search history.

(56) References Cited

U.S. PATENT DOCUMENTS 4,874,160 A * 10/1989 Yamamoto ..... 271/227
5,734,404 A * 3/1998 Komuro et al. ..... 347/104
6,000,692 A * 12/1999 Lee ..... 271/248
6,454,254 B2 * 9/2002 Yamaguchi et al. ..... 271/171
7,014,183 B2 * 3/2006 Tamura et al. ..... 270/58.09
7,111,934 B2 * 9/2006 Okuda et al. ..... 347/104
7,300,052 B2 * 11/2007 Tamura et al. ..... 271/221
2002/0017754 A1 * 2/2002 Kang ..... 271/223
2003/0178764 A1 * 9/2003 Hasegawa ..... 271/171

FOREIGN PATENT DOCUMENTS

CN 1406848 4/2003
JP 52-144736 11/1977

(Continued)

OTHER PUBLICATIONS

Office Action issued in Korean Patent Application No. 2005-99176 on Nov. 6, 2006.

(Continued)

*Primary Examiner*—Patrick Mackey
*Assistant Examiner*—Prasad V Gokhale
(74) *Attorney, Agent, or Firm*—Stein, McEwen & Bui, LLP

(57) ABSTRACT

A versatile paper feeding device of an image forming apparatus includes a pick-up roller, a paper support tray under the pick-up roller to stack paper on, a paper support expansion tray to be able to freely slide toward or away from the paper support tray to support the trailing edge of the paper, a forward positioned paper alignment guide on the paper support tray to align a leading end portion of the paper, and a second paper alignment member formed on the paper support expansion tray to align a following end portion of the paper. When the versatile paper feeding device is used to print images on paper of various sizes, the paper can be properly positioned and straightly fed without skewing.

25 Claims, 9 Drawing Sheets

FOREIGN PATENT DOCUMENTS

| | | |
|---|---|---|
| JP | 61-88933 | 6/1986 |
| JP | 61-105329 | 7/1986 |
| JP | 2001-240251 | 9/2001 |
| JP | 2002-044325 | 2/2002 |
| KR | 1999-83229 | 11/1999 |
| KR | 2000-9672 | 6/2000 |
| KR | 2003-80858 | 10/2003 |

OTHER PUBLICATIONS

Office Action issued by the Chinese Intellectual Property Office in Chinese Patent Application No. 2006101360739 on May 30, 2008.

* cited by examiner

VERSATILE PAPER FEEDING DEVICE OF IMAGE FORMING APPARATUS

CROSS-REFERENCE TO RELATED APPLICATIONS

This application claims the benefit of Korean Application No. 2005-99176, filed Oct. 20, 2005, in the Korean Intellectual Property Office, the entire content of which is incorporated herein by reference.

BACKGROUND OF THE INVENTION

1. Field of the Invention

Aspects of the present invention relate to a paper feeding device of an image forming apparatus. More particularly, aspects of the present invention relate to a versatile paper feeding device that can straightly feed papers without skewing when images are printed on various sizes of papers.

2. Description of the Related Art

An image forming apparatus such as a laser printer or a copier comprises a paper feeding device for feeding a print medium such as printing paper (hereinafter, paper) into the image forming apparatus body. The paper feeding device comprises a pick-up roller for picking up an individual sheet of the paper. One image forming apparatus may comprise a plurality of various kinds of feeding devices. Among the feeding devices, a versatile paper feeding device is necessitated to easily print on a small number of sheets of paper without having to open the feeding cassette, or to easily print on various sizes of paper such as an envelope or a small paper.

FIGS. 1 and 2 show the versatile paper feeding device. Referring to FIGS. 1 and 2, the versatile paper feeding device 1 comprises a pick-up roller 10, a paper support member 22 disposed under the pick-up roller 10 to stack sheets of paper thereon, a paper support expansion member 21 formed to be capable of freely sliding toward the paper support member 22 to support the paper, and a paper alignment member 23 formed on the paper support member 22 to align the paper. The versatile paper feeding device 1 may be formed on a side cover frame 40 of the image forming apparatus. In the versatile paper feeding device 1, as signals are transmitted to the image forming apparatus, a rotative shaft 12 is rotated by a driving device (not shown) and the pick-up roller 10 is simultaneously rotated so that the paper S is moved in direction A of FIG. 2 and fed to the next step, i.e., a feeding roller (not shown) one at a time. As the versatile paper feeding device 1 prints on paper with a relatively greater size in a lengthwise direction such as letter, A4 or legal size, sufficient area for supporting the paper S cannot be obtained by using only the paper support member 22. Therefore, the paper support expansion member 21 is extended so that sufficient area for supporting the paper S in a lengthwise direction is obtained and then the paper S is put thereon. Additionally, as the paper S is advanced in direction A for printing an image thereon, the paper alignment member 23 formed on the paper support member 22 is properly adjusted in an arrow direction B↔C to constrain the paper S from moving in a widthwise direction.

However, the conventional versatile paper feeding device 1 has the paper alignment member 23 formed only on the paper support member 22 of the leading end of the paper but has no separate paper alignment member on the paper support expansion member 21 of the following end of the paper. Therefore, as the versatile paper feeding device 1 prints on a paper with a relatively greater size in a lengthwise direction such as letter, A4 or legal size, the following end of the paper S is free to move in arrow direction D↔E, while the paper S is fed through the pick-up roller 10 to the feeding roller (not shown), such that a skew occurs. When the paper S with a skew is fed to the feeding roller, the image is skewed as much as the paper S is skewed, and further, a jam may occur.

SUMMARY OF THE INVENTION

Accordingly, aspects of the present invention are to solve at least the above and/or other problems and to provide advantages including the advantages described below. Therefore, an aspect of the present invention is to provide a versatile paper feeding device in which a following end of a paper is not skewed but straightly fed as an image forming apparatus prints on various sizes of paper so that printing quality can be enhanced.

An aspect of the invention provides a versatile paper feeding device, comprising a pick-up roller, a paper support member disposed under the pick-up roller to stack a paper thereon, a paper support expansion member formed to be capable of freely sliding toward the paper support member to support the paper, a first paper alignment member formed on the paper support member to align a leading end portion of the paper, and a second paper alignment member formed on the paper support expansion member to align a following end portion of the paper.

According to an aspect of the invention, the first paper alignment member may be slidingly formed in a traversing direction against a forwarding direction of the paper on the paper support member so as to align with a width size of the paper fed by the pick-up roller and thereby constrain transverse movement of the paper.

According to an aspect of the invention, the second paper alignment member may be formed to adjust to the width of the paper, where there are at least two different widths of paper to adjust to, to align the following end portion of the paper.

According to an aspect of the present invention, the second paper alignment member may comprise a supporting shaft detachably formed on the paper support expansion member, a pair of first protrusions each formed adjacent to an opposite end of the supporting shaft to adjust to the width of the paper, and a pair of second protrusions each formed adjacent to an opposite end of the supporting shaft and distanced from the pair of the first protrusions by a certain angle to adjust to a width of another paper.

According to an aspect of the present invention, the supporting shaft may comprise a stopper to stop the supporting shaft in a stable position when the supporting shaft is rotated by a certain angle.

According to an aspect of the present invention, the pair of the first protrusions and the pair of the second protrusions may be integrally formed with the supporting shaft. In an embodiment, the pair of the first protrusions and the pair of the second protrusions may be formed to be distanced from each other by about 90 degrees. The supporting shaft may be formed at a receiving part of the paper support expansion member so as to smoothly rotate with the first and the second protrusions.

According to another aspect of the present invention, the paper support expansion member may further comprise slits to receive the first and the second protrusions of the second paper alignment member.

According to another aspect of the present invention, the paper support member has a following end portion that is downwardly extended so that a certain space can be obtained within a boundary surface contacting the paper support expansion member.

According to an aspect of the invention, as the paper support expansion member is slid outward from the paper support member, the first and the second protrusions of the second paper alignment member collide with the following end portion of the paper support member so as to rotate in a forward or a backward direction and pass.

According to another aspect of the present invention, the second paper alignment member may comprise a supporting shaft detachably formed on the paper support expansion member, a pair of first protrusions formed adjacent to opposite ends of the supporting shaft to adjust to the width of a first size of paper, a pair of second protrusions formed to be distanced from the pair of the first protrusions by a certain angle to adjust to a width of a second size of paper, and a pair of third protrusions formed to be distanced from the second protrusions by a certain angle so as to adjust to a width of a third size of paper. According to an aspect of the invention, the paper support expansion member further comprises slits to receive the first, the second and the third protrusions of the second paper alignment member.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 5A is a detailed view of a left side thereof, FIG. 5B is a front view of a right side thereof and FIG. 5C is a right side view thereof;

DETAILED DESCRIPTION OF THE EMBODIMENTS

Figure 1:
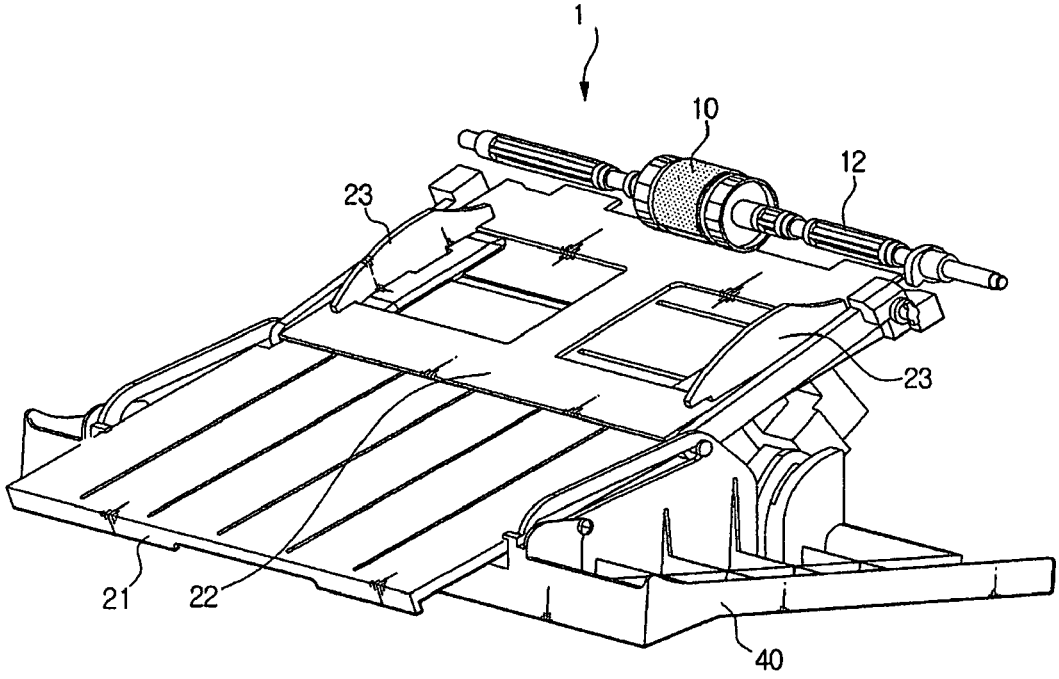
FIG. 1 (PRIOR ART)
FIG. 1 is a perspective view of a conventional versatile paper feeding device.
Figure 2:
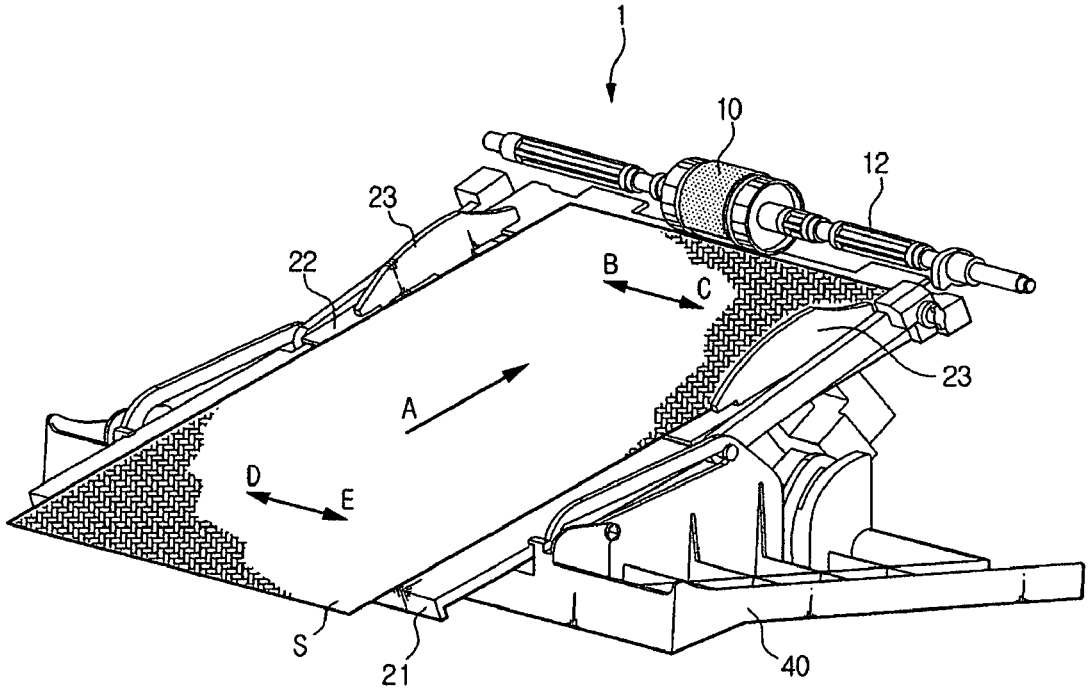
FIG. 2 (PRIOR ART)
FIG. 2 is a view showing a status in which a paper is stacked on the versatile paper feeding device of FIG. 1.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 3:
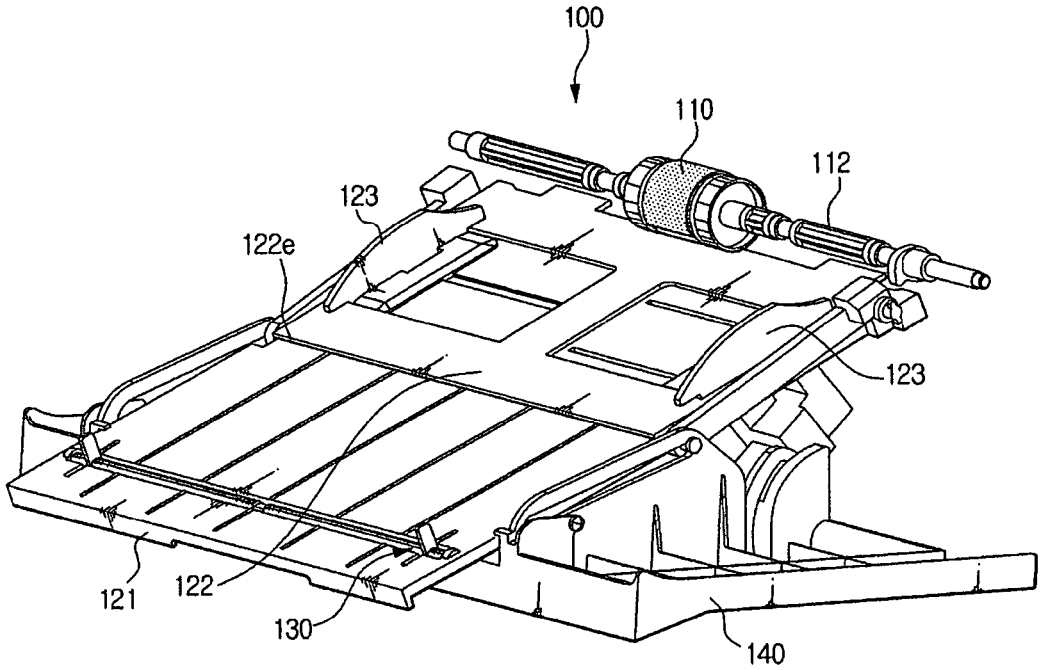
FIG. 3 is a perspective view of a versatile paper feeding device according to an embodiment of the present invention.
Figure 4:
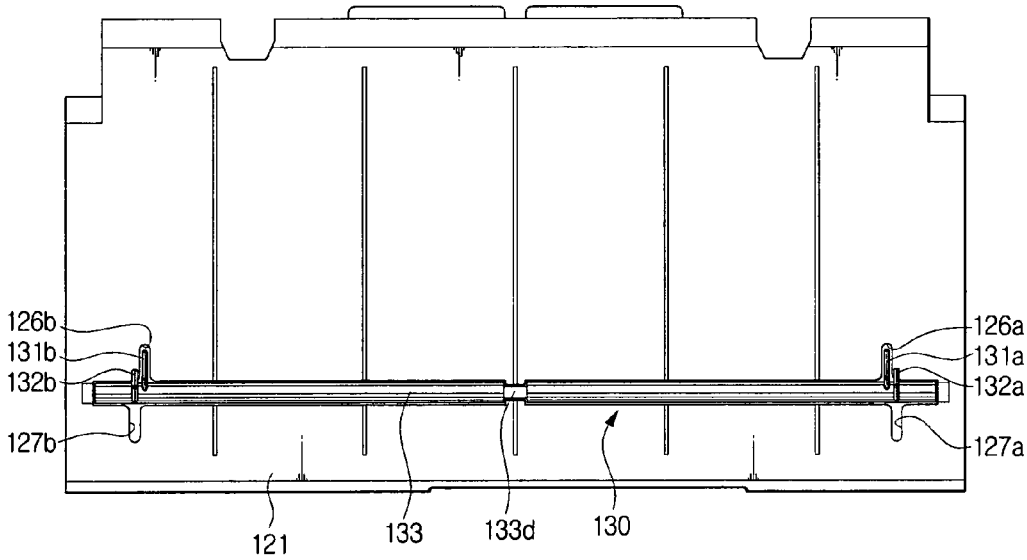
FIG. 4 is a plan view of a paper support member of FIG. 3.
Figure 5A:
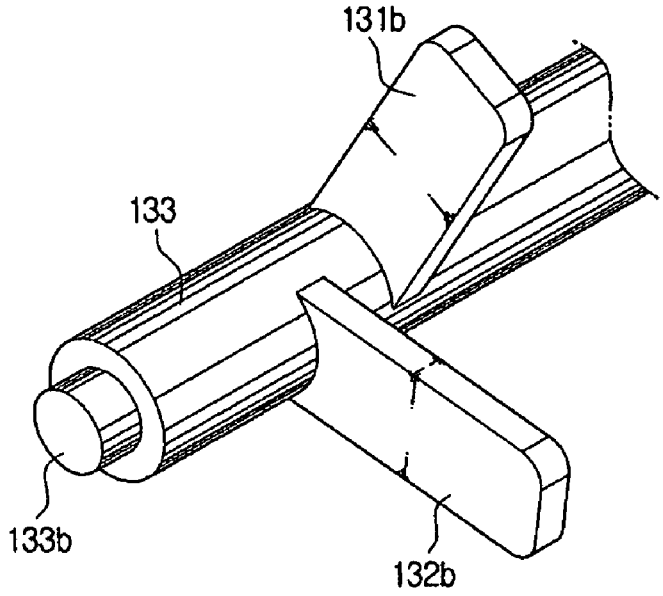
FIGS. 5A, 5B and 5C are detailed construction views of a second paper alignment member of FIG. 3.
Figure 5B:
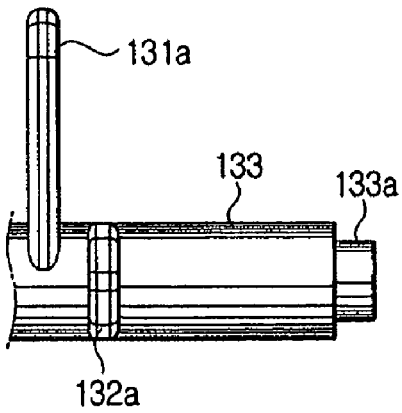
Figure 5C:
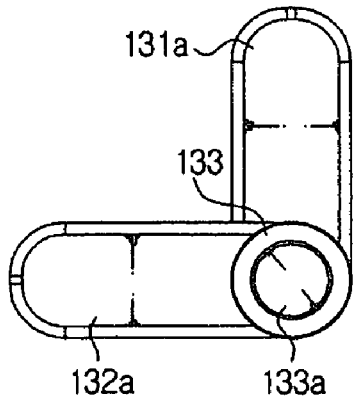

FIG. 3 is a perspective view of a versatile paper feeding device according to an embodiment of the present invention, and FIG. 4 is a plan view of a paper support expansion member of the versatile paper feeding device. Although the term paper is used throughout the description, it is not meant to limit the invention thereto, that is, the term paper is meant to encompass print medium such as paper, card stock, transparencies, envelopes, etc.

Figure 10:
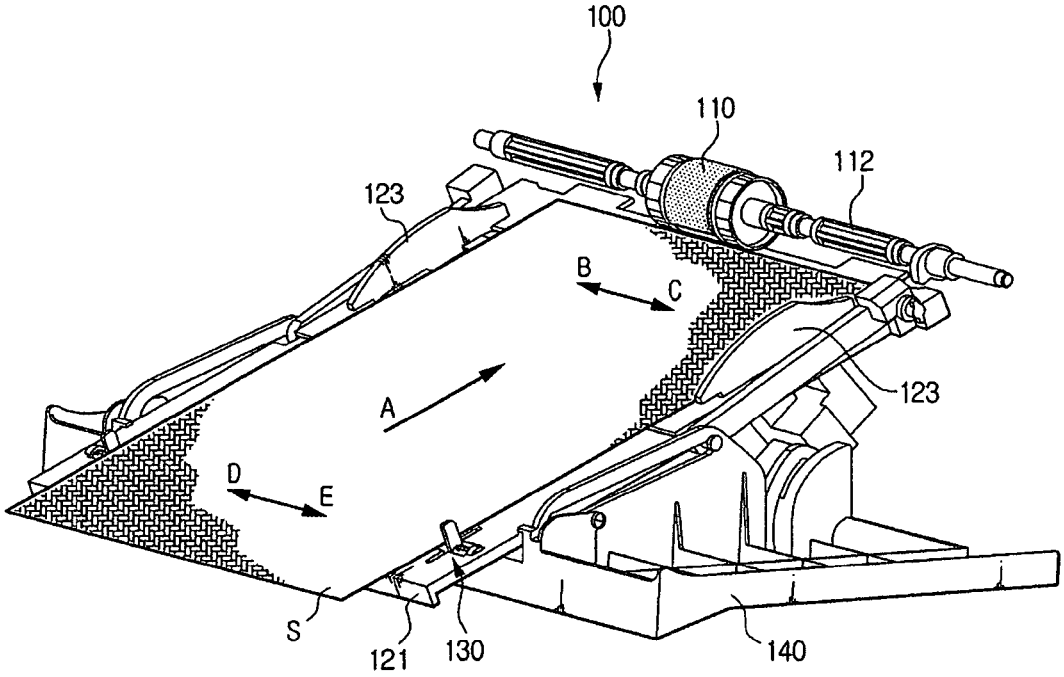
FIG. 10 is a view of a status in which a paper is stacked on the versatile paper feeding device of FIG. 3.

Referring to FIGS. 3 and 4, a versatile paper feeding device 100 according to an embodiment of the present invention, comprises a first paper alignment member 123 formed on a paper support member 122 to align a leading end of a paper S and prevent any free movement of the paper S in a widthwise direction while the paper S is fed in a forward direction A (refer to FIG. 10). In the versatile paper feeding device 100, a second paper alignment member 130 is further formed on the paper support expansion member 121 to prevent the free movement of a following end of the paper S in a width wise direction D↔E in FIG. 10.

The versatile paper feeding device 100 comprises a pick-up roller 110 engaged with a rotative shaft 112, a paper support member 122 to stack the paper S thereon, a paper support expansion member 121, and paper alignment members 123 and 130 to align the paper S.

The pick-up roller 110 is engaged with the rotative shaft 112 to be rotated together by a driving source (not shown).

The paper support member 122 is disposed under the pick-up roller 110 to stack the paper S thereon so that the pick-up roller 110 can feed an individual sheet of the paper S into an image forming apparatus. The paper support member 122 may be generally formed on a side cover frame 140 of the image forming apparatus.

The paper support expansion member 121 is formed on the side cover frame 140 so as to freely slide toward the paper support member 122 and to support a large size of a paper. The paper support expansion member 122 has a following end portion 122*e* that is downwardly extended so that a certain space H (refer to FIG. 9) can be obtained within a boundary surface contacting the paper support expansion member 121. In the specification of the present invention, a 'leading end portion' refers to a front portion of a paper, first in a feeding direction in the versatile paper feeding device 100, and a 'following end portion' refers to a portion near the opposite end of the paper in the paper feeding direction.

The paper support member 122 and the paper support expansion member 121 of the versatile paper feeding device according to an embodiment of the present invention include the paper alignment members 123 and 130, respectively.

The first paper alignment member 123 is formed on the paper support member 122 to align the leading end portion of the paper S. The first paper alignment member 123 is slidingly formed in a traverse direction to a paper feeding direction of the paper S on the paper support member 122 so as to align with the width size of the paper S fed by the pick-up roller 110 and constrain the transverse movement thereof.

The second paper alignment member 130, which is not included in the conventional versatile paper feeding device, is detachably formed on the paper support expansion member 121. The second paper alignment member 130 is formed near the following end portion of the paper S to align the following end portion of the paper S. The second paper alignment member 130 is formed to adjust to the width of the paper, where the second paper alignment member 130 can adjust to at least two different paper widths, and align the following end portion of the paper.

Figure 6:
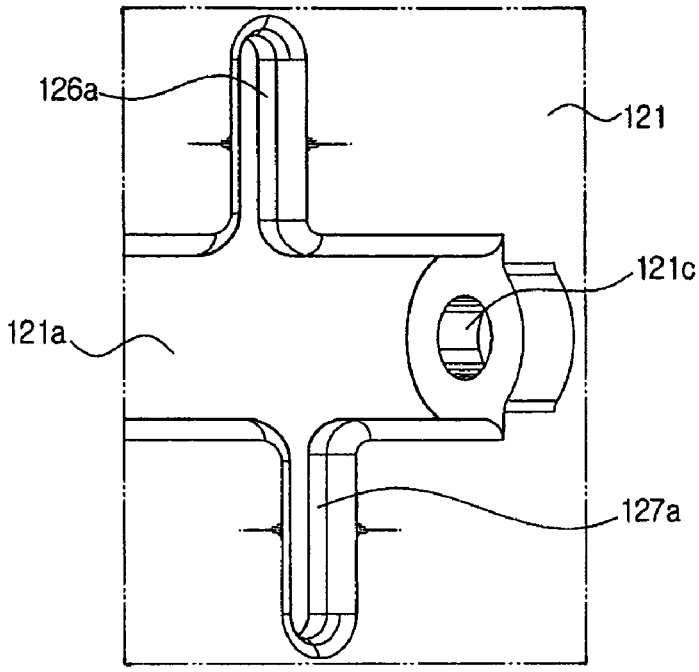
FIG. 6 is a detailed view of a part of a paper support expansion member having a receiving part for receiving the second paper alignment member.
Figure 7:
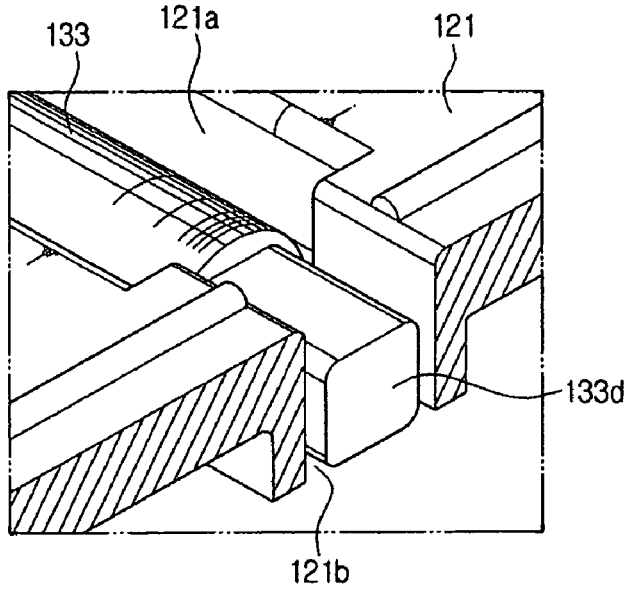
FIG. 7 is a detailed view of a central portion of the second paper alignment member of FIG. 3.
Figure 8:
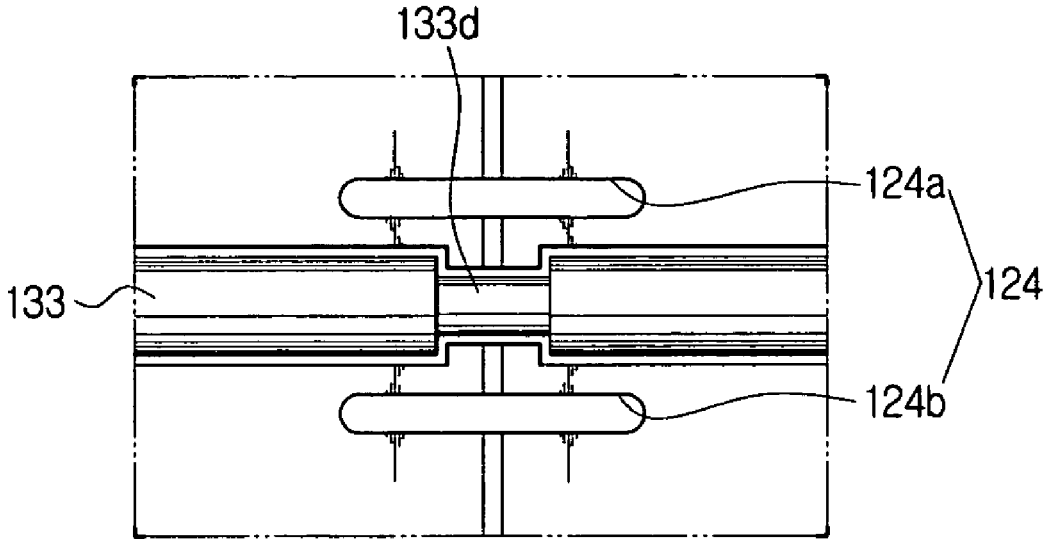
FIG. 8 is a detailed view of a part of a central portion of the paper support expansion member of FIG. 3 according to another embodiment of the present invention.

FIGS. 5 through 8 are the detailed construction views of the second paper alignment member. FIG. 5A is a detailed view of a left side of the second paper alignment member 130, FIG. 5B is a front view of a right side thereof, and FIG. 5C is a right side view thereof. FIG. 6 is a detailed view of a part of a paper support expansion member 121 having a receiving part 121*a* for receiving the second paper alignment member 130. FIG. 7 is a detailed view of a central portion of the second paper alignment member 130, and FIG. 8 is a detailed view of a part of a central portion of another embodiment of the paper support expansion member 121.

Referring to FIG. 4, the second paper alignment member 130 comprises a supporting shaft 133 and two pairs of protrusions 131*a*, 131*b* and 132*a*, 132*b*, respectively.

The supporting shaft 133 is cylindrical and has supporting protrusions 133*a*, 133*b* formed on each end portion. The supporting shaft 133 is formed at the receiving part 121*a* of the paper support expansion member 121. The supporting shaft 133 may be momentarily elastically bent by force so that the supporting protrusions 133*a*, 133*b* are inserted into or separated from a supporting groove 121*c* of the receiving part 121*a*. Therefore, the supporting shaft 133 can be detached from and attached to the paper support expansion member 121 by snapping out of and in place, respectively. As attached to the paper support expansion member 121, the supporting shaft 133 can be rotated. In the central portion of the supporting shaft 133, a stopper 133*d*, which is non-circular, may be formed. The receiving part 121*a* in the central portion of the paper support expansion member 121 is formed to be narrow 121*b* so that the stopper 133*d* can be inserted therein. The supporting shaft 133 can thus be located in a regular position by the stopper 133*d*, and therefore, the protrusions 131*a*, 131*b*, 132*a*, and 132*b* of the supporting shaft 133 can also be located in corresponding regular positions.

The paper support expansion member 121 is made of elastically deformable material such as plastic or metal so that rounded edges of the stopper 133*d* can slightly push the inner wall of the paper support expansion member 121 as the stopper 133*d* of the central portion of the paper support expansion member 121 is rotated. Accordingly, the stopper 133*d* can stop the second paper alignment member 130 in a stable position after the second paper alignment member 130 is rotated by a certain angle. As shown in FIG. 8, the paper support expansion member 121 may further comprise, in a central portion, buffering slits 124*a*, 124*b* so that the stopper 133*d* can more smoothly operate.

Each protrusion 131*a*, 131*b* of the first pair is formed adjacent to each respective end of the supporting shaft 133 to adjust to the width of the paper S. The protrusions 132*a*, 132*b* of the second pair may each be formed at a certain distance and angle from each respective protrusion 131*a*, 131*b* of the first pair, to adjust to the width of another size of paper. The first pair of protrusions 131*a*, 131*b* and the second pair of protrusions 132*a*, 132*b* may be integrally formed with the supporting shaft 133. According to an embodiment, the first pair of protrusions and the second pair of protrusions may be formed from each other by an angle of about 90 degrees.

The protrusions 131*a*, 131*b*, are formed to adjust to the width of a relatively large size of paper such as A4 and similarly, the protrusions 132*a*, 132*b* may be formed to adjust to the width of letter size. However, this should not be considered as limiting. At least one of the pair of protrusions may be formed to adjust to the width of a smaller size of paper as necessary. Although not shown, according to another embodiment, a third pair of protrusions, in addition to the two pairs of protrusions 131*a*, 131*b*, and 132*a*, 132*b*, may be further formed to adjust to the width of a third size of paper. For example, the pair of third protrusions may be formed on the supporting shaft 133 at an appropriate distance and at an appropriate angle from the two pairs of protrusions 131*a*, 131*b*, and 132*a*, 132*b*, for example, by approximately 90 degrees and 180 degrees from the second and first pairs, respectively, so as to adjust to the width of another size of paper. The pairs of protrusions can be straight parallel protrusions according to an embodiment of the invention, however, the protrusions need not be. That is, the protrusions may be set at an angle to the supporting shaft 133 or the individual protrusion may have a bend to strengthen the protrusion, facilitate paper alignment and/or facilitate the rotation of the supporting shaft 133.

The paper support expansion member 121 includes slits 126*a*, 126*b*, 127*a*, 127*b* corresponding to the protrusions so as to receive the protrusions 131*a*, 131*b*, 132*a*, 132*b* of the second paper alignment member 130. If a plurality of pairs of protrusions are formed, the paper support expansion member 121 needs to include a corresponding plurality of pairs of slits to receive the plurality of pairs of protrusions.

The operations of the versatile paper feeding device according to an embodiment of the present invention will be explained hereinafter with reference to accompanying drawings.

FIG. 9 is a view for explaining the operation of the second paper alignment member 130 and FIG. 10 is a view for explaining the operation of the versatile paper feeding device 100 according to an embodiment of the present invention. Referring to FIGS. 9 and 10, in the versatile paper feeding device 100, the paper support expansion member 121 is slid outward of the paper support member 122. At this time, one of the pairs of protrusions 131*a*, 131*b* and 132*a*, 132*b* of the second paper alignment member 130 collide with the following end portion 122*e* of the paper support member 122 and rotate in a forward or backward direction so as to pass the following end portion 122*e* of the paper support member 122. To this end, the following end portion 122*e* of the paper support member 122 is downwardly extended so as to obtain a certain space H within a boundary surface contacting the paper support expansion member 121.

When image printing is not desired, the versatile paper feeding device 100 is pushed into the image forming apparatus body, the paper support expansion member 121 is slid in a paper forwarding direction, i.e., the direction A, so that one of the pairs of protrusions 131*a*, 131*b* and 132*a*, 132*b* of the second paper alignment member 130 collide with the following end portion 122*e* of the paper support member 122, rotate and smoothly pass. For example, the second pair of protrusions 132*a*, 132*b* retreat into the slits 127*a*, 127*b* and the first pair of protrusions 131*a*, 131*b* rotate up in the space H as shown in FIG. 9B. Similarly, when the versatile paper feeding device 100 is drawn from the image forming apparatus body to print an image, the paper support expansion member 121 is pulled in an opposite direction to the paper forwarding direction, i.e., the direction −A, so that one of the pairs of protrusions 131*a*, 131*b* and 132*a*, 132*b* of the second paper alignment member 130 collide with the following end portion 122*e* of the paper support member 122, rotate in the opposite direction and smoothly pass. Particularly, as shown in FIG. 9A, the first pair of protrusions 131*a*, 131*b* retreat into the slits 126*a*, 126*b* and the second pair of protrusions 132*a*, 132*b* pop up.

Figure 9A:
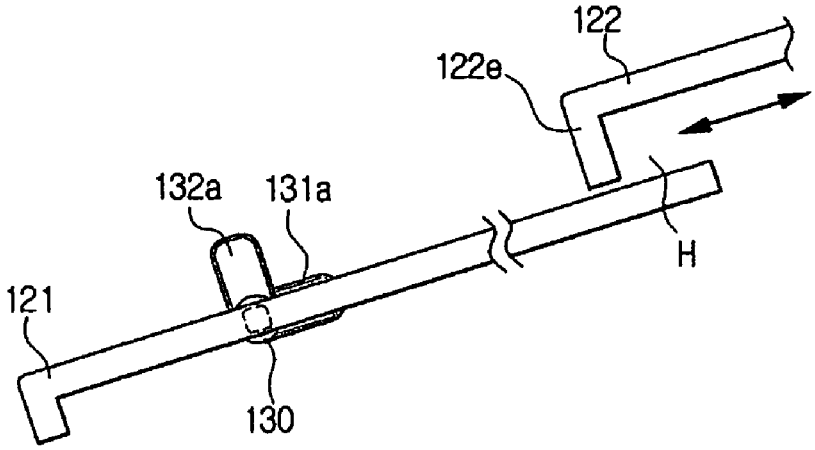
FIGS. 9A and 9B are views for explaining the operation of the second paper alignment member of FIG. 3.
Figure 9B:
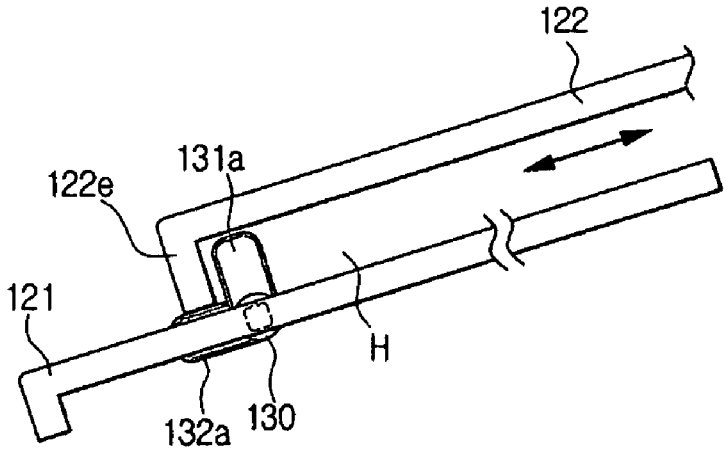

When the paper support expansion member 121 is positioned as in FIG. 9A, the versatile paper feeding device 100 can align the following end portion of the paper S by the pairs of protrusions 131*a*, 131*b* or 132*a*, 132*b* of the second paper alignment member 130 when an A4 or letter size of paper is fed. In other words, if A4 size of paper is placed on the paper support member 122 and the paper support expansion member 121, the second paper alignment member 130 is rotated by a certain angle so that the first pair of protrusions 131*a*, 131*b* pop up adjusted to the width of the A4 size of paper so as to align the following end portion of the paper. On the contrary, when letter size of paper is placed on the paper support member 122 and the paper support expansion member 121, the second paper alignment member 130 is rotated so that the second pair of protrusions 132*a*, 132*b* of the supporting shaft 133 pop up adjusted to the width of the letter size of paper so as to align the following end portion of the letter size paper.

As the certain size of paper is stacked and print signals are received from a central control part (not shown) to print an image, the rotative shaft 112 is rotated and the pick-up roller 110, coaxially formed with the rotative shaft 112, is also rotated. The paper S is moved in direction A of FIG. 10 and fed to the next step, i.e., the feeding roller (not shown). In other words, while the paper S is picked up by the pick-up roller 110 and moved in direction A, the protrusions 131*a*, 131*b*, 132*a*, 132*b* of the second paper alignment member 130 align the following end portion of the paper so that the paper S is straightly fed without a skew to the next step, i.e., the feeding roller. For the straightly aligned paper S, skew can be eliminated when the following end portion of the paper S leaves from the second paper alignment member 130 at the moment when the leading end portion of the paper S is fed to the feeding roller.

The versatile paper feeding device 100 according to an embodiment of the present invention, further includes the second paper alignment member besides the first paper alignment member so that the paper is straightly fed to the feeding roller and not skewed when an image is printed. Therefore, the side skew can be prevented, an even side margin can be achieved and the quality of paper feeding can be enhanced.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A versatile paper feeding device, comprising:

a pick-up roller;

a paper support member disposed under the pick-up roller to stack a paper thereon;

a paper support expansion member freely slidable toward the paper support member to support the paper;

a first paper alignment member formed on the paper support member to align a leading end portion of the paper; and a second paper alignment member formed on the paper support expansion member to align a following end portion of the paper, the second paper alignment member comprising:

a supporting shaft formed on the paper support expansion member, and a plurality of protrusions formed adjacent to opposite ends of the supporting shaft to rotatable adjust to a width of the paper, to align the following end portion of the paper, wherein the supporting shaft is formed at a receiving part of the paper support expansion member so as to rotate with the plurality of protrusions, and the second paper alignment changes a position thereof according to whether the paper support expansion member is inserted into or removed from the paper support member.

2. The device as claimed in claim 1, wherein the first paper alignment member is slidable in a traversing direction against a forwarding direction of the paper on the paper support member so as to align the paper fed by the pick-up roller in a width direction.

3. The device as claimed in claim 1, wherein the second paper alignment member is adjustable to the width of the paper, to align the following end portion of the paper.

4. The device as claimed in claim 3, wherein the plurality of protrusions comprises:

a pair of first protrusions formed adjacent to opposite ends of the supporting shaft to adjust to the width of the paper; and a pair of second protrusions formed on the supporting shaft to be distanced and rotated from the pair of the first protrusions by a certain distance and angle to adjust to a width of another paper.

5. The device as claimed in claim 4, wherein the pair of the first protrusions and the pair of the second protrusions are integrally formed with the supporting shaft.

6. The device as claimed in claim 4, wherein the pair of the first protrusions and the pair of the second protrusions are formed to be rotated from each other by approximately 90 degrees.

7. The device as claimed in claim 4, wherein the paper support expansion member further comprises slits to receive the first and the second protrusions of the second paper alignment member.

8. The device as claimed in claim 4, wherein the supporting shaft comprises a stopper to stop the supporting shaft after the supporting shaft is rotated by a certain angle.

9. The device as claimed in claim 8, wherein the support expansion member is elastically deformable adjacent to a location where the stopper is formed.

10. The device as claimed in claim 8, wherein the paper support expansion member comprises a buffering slit formed adjacent to a location where the stopper is formed.

11. The device as claimed in claim 4, wherein as the paper support expansion member is slid inward or outward of the paper support member, the first or the second protrusions of the second paper alignment member collide with the following end portion of the paper support member and rotate to pass in a forward or backward direction.

12. The device as claimed in claim 3, wherein the plurality of protrusions comprises:

a pair of first protrusions formed adjacent to opposite ends of the supporting shaft to adjust to the width of the paper;

a pair of second protrusions formed on the supporting shaft to be distanced and rotated from the pair of the first protrusions by a certain distance and angle to adjust to a width of another size of paper; and a pair of third protrusions formed on the supporting shaft to be distanced and rotated from the second protrusions by a certain distance and angle so as to adjust to a width of a third size of paper.

13. The device as claimed in claim 12, wherein the paper support expansion member further comprises slits to receive the first, the second and the third protrusions of the second paper alignment member.

14. The device as claimed in claim 12, wherein the pair of the first protrusions, the pair of the second protrusions and the pair of the third protrusions are each formed to be distanced from the preceding pair by approximately 90 degrees.

15. The device as claimed in claim 12, wherein the plurality of protrusions further comprises a pair of fourth protrusions formed on the supporting shaft to be distanced and rotated from the third protrusion by a certain distance and angle so as to adjust to a width of a fourth size of paper.

16. The device in claim 15, wherein the paper support expansion member further comprises slits to receive the fourth protrusions.

17. The device as claimed in claim 15, wherein the pair of the first protrusions, the pair of the second protrusions, the pair of the third protrusions and the pair of fourth protrusions are formed to be distanced from one another by approximately 90 degrees.

18. The device as claimed in claim 1, wherein the supporting shaft is elastically deformable to attach and detach to the paper support expansion member.

19. The device as claimed in claim 1, wherein the paper support member has a following end portion that is downwardly extended so that a certain space is obtainable within a boundary surface contacting the paper support expansion member.

20. A versatile paper feeding device, comprising:

a paper support member to stack a paper thereon;

a paper feeding member to feed the paper from the paper support member to an image forming apparatus; and a paper alignment member formed on the paper support member to align a following end portion of the paper prior to feeding to prevent skewed paper feeding, the paper alignment member comprising:

a supporting shaft formed on the paper support member, and a plurality of protrusions formed adjacent to opposite ends of the supporting shaft to rotatable adjust to a width of the paper, to align the following end portion of the paper, wherein the supporting shaft is formed at a receiving part of the paper support member so as to rotate with the plurality of protrusions.

21. A versatile paper feeding device, comprising:

a paper support member to stack a paper thereon;

a paper feeding member to feed the paper from the paper support to an image forming apparatus;

a first paper alignment member formed on the paper support member to guide a leading end portion of the paper prior to feeding; and a second paper alignment member formed on the paper support member to simultaneously guide a following end portion of the paper to prevent skewed paper feeding, the second paper alignment member comprising:

a supporting shaft formed on the paper support member, and a plurality of protrusions formed adjacent to opposite ends of the supporting shaft to rotatably adjust to a width of the paper, to align the following end portion of the paper, wherein the supporting shaft is formed at a receiving part of the paper support member so as to rotate with the plurality of protrusions.

22. An image forming apparatus, comprising:

a case;

a feeding roller;

a driving unit installed in the case to rotate the feeding roller; and a versatile paper feeding device installed on a side cover of the case, the paper feeding device comprising:

a paper support member to stack a paper thereon to supply the paper to the feeding roller, a paper support expansion member freely slidable outward and inward of the paper support member to support the following end portion of the paper, a first paper alignment member formed on the paper support member to align a leading end portion of the paper, and a second paper alignment member formed on the paper support expansion member to align the following end portion of the paper, the second paper alignment member comprising:

a supporting shaft formed on the paper support expansion member, and a plurality of protrusions formed adjacent to opposite ends of the supporting shaft to rotatably adjust to a width of the paper, to align the following end portion of the paper, wherein the supporting shaft is formed at a receiving part of the paper support expansion member so as to rotate with the plurality of protrusions, and the second paper alignment changes a position thereof according to whether the paper support expansion member is inserted into or removed from the paper support member.

23. A method of aligning a following end portion of a paper to feed into an image forming apparatus comprising:

sliding a paper support expansion member outward of a paper support member; and colliding a pair of first protrusions on a paper alignment member to cause the paper alignment member to rotate such that the pair of first protrusions rotates into slits on the paper support expansion member and a pair of second protrusions on the paper alignment member rotates up at a width of a size of a paper to guide the following end portion of the paper.

24. The method of claim 23, further comprising:

constraining the following end portion of the paper in the width direction until a leading end portion of the paper is taken up by feeding rollers in the image forming apparatus.

25. The method of claim 23, further comprising:

sliding the paper support expansion member toward the paper support member; and colliding the pair of second protrusions on the paper alignment member to cause the paper alignment member to rotate such that the pair of second protrusions rotates into slits on the paper support expansion member and the pair of first protrusions on the paper alignment member rotates up.

* * * * *

UNITED STATES PATENT AND TRADEMARK OFFICE

CERTIFICATE OF CORRECTION

PATENT NO. : 7,434,801 B2
APPLICATION NO. : 11/500347
DATED : October 14, 2008
INVENTOR(S) : Chun-seung Yang It is certified that error appears in the above-identified patent and that said Letters Patent is hereby corrected as shown below:

Column 7, line 56, change “rotatable” to --rotatably--.

Column 9, line 28, change “rotatable” to --rotatably--.

Signed and Sealed this

Twenty-third Day of December, 2008

JON W. DUDAS
*Director of the United States Patent and Trademark Office*